United States Patent [19]

Edwards et al.

[11] 4,131,455

[45] Dec. 26, 1978

[54] SILVER RECOVERY

[75] Inventors: Lars T. Edwards; Lyle N. Trowbridge, both of Queensbury, N.Y.

[73] Assignee: GAF Corporation, New York, N.Y.

[21] Appl. No.: 859,154

[22] Filed: Dec. 9, 1977

[51] Int. Cl.[2] ..... C22B 11/04

[52] U.S. Cl. ..... 75/118 R; 75/100; 75/108; 75/0.5 A

[58] Field of Search ..... 75/108, 118 R, 118 P, 75/100, 0.5 A

[56] References Cited

U.S. PATENT DOCUMENTS

| | | | |
|---|---|---|---|
| 2,752,237 | 6/1956 | Short | 75/118 R |
| 3,334,995 | 8/1967 | Gaspar | 75/108 |
| 3,369,886 | 2/1968 | Metzger et al. | 75/0.5 A |
| 3,658,510 | 4/1972 | Hoffmann et al. | 75/118 R |
| 3,940,261 | 2/1976 | Dannelly et al. | 75/0.5 A |

*Primary Examiner*—G. Ozaki

*Attorney, Agent, or Firm*—Walter C. Kehm; Joshua J. Ward

[57] ABSTRACT

Method for recovering pure silver from acid insoluble silver salt contaminated with other metals by first washing the salt with water at a pH less than 3 and then reacting the washed salt with alkali metal borohydride at a pH greater than 12.

9 Claims, No Drawings

SILVER RECOVERY

BACKGROUND OF THE INVENTION

The present invention provides means for economically purifying silver and recovering silver in pure form from silver salt without the necessity for re-refining the silver to obtain the desired levels of purity. More specifically, the invention provides a method for removing metal contaminants from acid insoluble silver salts and a process for recovery of metallic silver of high purity from aqueous solutions of silver salts contaminated with metals other than silver.

Conventionally, silver bearing wastes such as silver nitrate which contain undesirably large amounts of other metals are converted to silver chloride, dried and then re-refined to recover silver therefrom. Alternative chemical processes have generally been considered unsatisfactory because they are incapable of removing sufficient metal contaminants to obtain bullion grade silver. It has, for instance, been suggested that silver nitrate be reduced with sodium borohydride as a means of preparing colloidal silver free of excess reducing agent and reaction by-products and contaminants. A process for accomplishing this is described, for instance, in U.S. Pat. No. 3,334,995. Unfortunately, known processes involving use of alkali borohydrides for reduction of silver do not provide for removal of a number of the more common metal contaminants. While these processes are completely satisfactory for their intended uses, they are not satisfactory for recovery of bullion grade silver.

SUMMARY OF THE INVENTION

In accordance with the present invention, metallic silver of high purity is recovered from acid insoluble silver salt contaminated with more than 2,000 parts per million (ppm) of other metals by a process which comprises washing the silver salt with water at a pH less than 3 and then reacting the washed silver salt with alkali metal borohydride at a pH greater than 12. Metallic silver containing less than 1,000 ppm of other metals is then recovered from the process.

A preferred embodiment of the process of the invention involves recovery of silver from an aqueous solution of silver salt contaminated with more than 2,000 ppm based on silver of other metals by a method comprising:

a. precipitating silver from the solution as acid insoluble silver salt;
b. washing the acid insoluble silver salt with water at a pH of less than 3;
c. reacting the washed, acid insoluble salt with alkali metal borohydride at a pH greater than 12; and
d. recovering metallic silver contaminated with less than 1,000 ppm of such other metals.

DETAILED DESCRIPTION OF THE INVENTION

As mentioned, the invention involves recovery of silver of a high degree of purity from acid insoluble silver salt contaminated with other metals. A particularly preferred form of silver from which to recover silver in accordance with the invention is silver chloride, however, the invention is also applicable to recovery of silver from other acid insoluble silver salts which contain undesirable amounts of metal contaminants. Such salts may include, for instance, other silver halides, sulfates, phosphates, sulfides, etc. Metals with which the silver is contaminated typically may include, for instance, copper, nickel, iron, lead, sodium, potassium, cadmium, bismuth, calcium and mixtures thereof. The invention is especially useful for removal of copper, nickel, iron and lead contaminants. The contaminating metals may be present in a variety of forms, such as carbonates, halides, oxides, hydroxides, nitrates, sulfates, etc., but preferably are present in the form of nitrate salts. Since it is normally desirable for bullion grade silver to contain less than about 1,000 ppm other metals, the invention is directed primarily to recovery of silver of such purity from acid insoluble silver salts contaminated with more than 2,000 ppm based on silver of such other metals, especially salts contaminated with more than 10,000 ppm of such other metals.

Acid insoluble silver salts from which silver is recovered in accordance with the invention may come from any suitable source. For instance, in conventional processes for purification of silver nitrate, it is common to accumulate residual silver nitrate contaminated with large amounts of contaminants including metals other than silver. As mentioned above, it is impractical to merely convert such material to, e.g. silver chloride and reduce the silver chloride to metallic silver, since many of the metal contaminants, especially those metals mentioned above, form chlorides and would ordinarily also be reduced to metallic form. As discussed in greater detail below, solutions containing undesirably large amounts of such other metals are, however, perfectly suitable for treatment in accordance with the present invention. It is therefore a preferred embodiment of the invention to recover metallic silver of high purity from an aqueous solution of silver salt, such as silver nitrate contaminated with more than 2,000 ppm based on silver of other metals by precipitating the silver as an acid insoluble silver salt and then washing and reacting with borohydride as described above.

Concentration of silver in salts from which silver may be recovered in accordance with the various embodiments of the invention may cover an extremely wide range such as between about 60 and about 95 wt % silver. Contamination of silver with other metals, such as those mentioned above, may range from 1,000 ppm upwards to 10,000 ppm or even higher of contaminating metals. In general any aqueous solution of silver salt or acid insoluble silver salt contaminated with more than about 1,000 ppm other metals is suitable for treatment in accordance with the invention. In this context it is understood that the term acid insoluble silver salt refers to salt which is insoluble in aqueous solution at pH ranges between about 2 and about 6.

In treating acid insoluble silver salt contaminated with other metals in accordance with the invention, the salt is first washed with water at a pH of less than 3 and preferably a pH of not more than about 2. Depending upon the condition and prior treatment of the silver salt being washed, such silver salt may already be at a sufficiently low pH or may require pH adjustment before or during the washing operation. If, as is frequently the case, the pH of the silver salt being washed is about 3, then acid may be added to the wash water, at least during the initial stages of the washing, to reduce the pH to less than 3. This may be accomplished by addition of any suitable acid, such as nitric acid, sulfuric acid, hydrochloric acid, etc. to the wash water. A particularly suitable wash water, at least for the initial stages of washing where acid is required, is dilute aqueous solution of nitric acid containing about 2 gallons of concentrated nitric acid for each 30 gallons of water.

Washing of the acid insoluble silver salt with water at a pH less than 3 is continued until sufficient metal contaminants have been removed to yield the desired purity of silver product. Silver is generally considered sufficiently pure from a standpoint of metal contaminants when the other metals with which it is contaminated are present in amounts less than 1,000 ppm based on silver. Silver contaminated with less than about 100 ppm of metal contaminants is even more desirable and can frequently be obtained by practice of the invention.

Washing of acid insoluble silver salt at low pH in accordance with the invention is necessary to insure sufficient removal of metal contaminants. A number of common metal contaminants, including those mentioned above, form metal salts which precipitate at or above a pH of about 3. By maintaining the pH less than 3 while the silver salt is washed to the desired purity, the metal contaminants are maintained in solution or, if previously formed, are dissolved. The metal contaminants may then be removed with the wash water. The washing operation may be carried out in any conventional manner such as by batch mixing and filtering or may be carried out continuously on suitable filters, etc.

In practicing the invention, it is preferred that the washing of acid insoluble silver salt at low pH be carried out at temperatures between about 70° C. and about 100° C. At substantially lower temperatures, the washing operation takes longer to achieve product of desired purity. Low temperatures also tend to enhance peptization of the silver salt, especially silver chloride, to form colloidal silver which can then be lost with the wash water through even relatively fine filters, such as the one micron filters frequently used. Temperatures above 100° C. result in boiling off of water and substantially lessen the efficiency of the process.

Following the water wash at low pH, the acid insoluble silver salt is then reacted at a pH greater than 12 with alkali metal borohydride to form metallic silver, which may then be recovered by conventional means, such as filtration. Suitable alkali metal borohydrides include, for instance, sodium or potassium borohydride.

In order to carry out the reaction with borohydride at the desired ph of greater than 12, the acid washed silver salt may be adjusted to the higher pH by any conventional means such as addition of strong caustic such as alkali metal hydroxides, e.g. sodium, potassium or lithium hydroxide, ammonium hydroxide, etc. Sodium hydroxide is preferred for this purpose due to its relatively low cost and ease of handling. Regardless of the particular method used to adjust the pH of the acid washed silver salt, such adjustment should be made prior to reaction with the borohydride so that the reaction with the borohydride takes place at a pH of at least 12 and preferably at least about 12.5. Adjustment of pH to greater than 12 prior to reaction with borohydride is necessary to avoid evolution of hydrogen from the reaction with the borohydride. It is also preferred that the reaction with borohydride take place in the temperature range between about 60° C. and about 80° C. Lower temperatures tend to prolong the reaction undesirably while higher temperatures tend toward evolution of hydrogen by decomposition of the borohydride.

Following reaction of the acid washed silver salt with alkali metal borohydride, the metallic silver formed by the reaction is preferably washed with water to remove reaction products. Deionized water is preferred for this washing. The recovered silver will be found to be substantially free of metallic impurities, i.e. less than 1,000 ppm based on silver, and will also be substantially free of other contaminants. Washing of the recovered silver can be accomplished by conventional means, such as batch or continuous agitation with filtration or settling.

If, as is usually the case, an aqueous solution of silver salt from which pure silver is to be recovered in accordance with the invention contains dirt or other particulate contaminant, such contamination may be removed by conventional means, such as filtration, prior to treating the solution in accordance with the invention. For this purpose extremely fine filters on the order of, e.g. one micron are normally preferred.

The following examples illustrate embodiments of the invention, but are not intended to limit the scope of the invention.

EXAMPLE 1

To illustate the practice of the invention in recovering pure silver from silver nitrate containing relatively large amounts of metal contaminant, 246 ml of a 12 wt % aqueous solution of silver nitrate were placed in a beaker equipped with a magnetic stirrer. The silver nitrate solution had previously been filtered to remove gross impurities and contained 4.5 wt % nitric acid. The silver nitrate solution also contained the following metal contaminants:

| METAL | PPM BASED ON SILVER NITRATE |
|---|---|
| Copper | 40,000 |
| Sodium | 6,000 |
| Iron | 3,000 |
| Aluminum | 300 |
| Lead | 150 |

The temperature of the silver nitrate solution was increased to about 70° C. by heating the beaker while stirring the solution. Enough saturated aqueous solution of sodium chloride was then added with stirring to precipitate all of the silver as silver chloride. The precipitated silver chloride was allowed to settle, excess water was decanted and the silver chloride was then washed at a pH less than 3 to remove metal contaminants. The washing was accomplished in stages with stirring, settling, and decanting of each batch of wash water. The first three washings were with nitric acid in the form of a 30% aqueous solution while the last two stages of washing were with sulfuric acid in the form of a 5% aqueous solution. Temperature during the washing stages was maintained between 70° and 100° C.

Following the last stage of acid wash, sufficient water was added to bring the total volume in the beaker to 400 ml. 6 Grams of sodium hydroxide were then added in the form of concentrated aqueous solution to adjust the pH to about 12.5. A 3% aqueous solution of sodium borohydride stablized to a pH greater than 12 with sodium hydroxide was then added in an amount equivalent to 1.46 grams of sodium borohydride and the contents of the beaker thoroughly stirred. Temperature during this phase of the process was maintained between 60° and 80° C. The addition of the sodium borohydride precipitated the silver.

Following precipitation of silver, the silver was allowed to settle, liquid decanted and the silver was then subjected to multiple stages of washing with deionized water until the decanted wash water showed a conductivity equivalent to less than 1 ppm sodium chloride.

The resulting pure silver product contained the following metal contaminants based on silver:

| METAL | PPM BASED ON SILVER |
|---|---|
| Copper | 2 |
| Iron | 1 |
| Aluminum | 5 |

EXAMPLE 2

Silver nitrate in the form of a 21.6 wt % aqueous solution containing 19 wt % nitric acid was treated for recovery of pure silver in a manner generally similar to the manner set forth above for Example 1. The silver nitrate solution originally contained the following metal contaminants:

| METAL | PPM BASED ON SILVER NITRATE |
|---|---|
| Copper | 80,000 |
| Iron | 10,000 |
| Aluminum | 10,000 |
| Sodium | 8,000 |
| Calcium | 5,000 |
| Antimony | 2,000 |
| Chromium | 600 |
| Lead | 500 |
| Bismuth | 200 |
| Nickel | 200 |
| Tin | 200 |

The purified silver recovered from the process contained the following metal contaminants:

| METAL | PPM BASED ON SILVER |
|---|---|
| Copper | 5 |
| Iron | 10 |
| Lead | 9 |
| Bismuth | 6 |
| Tin | 20 |

EXAMPLE 3

In this Example, a 55 wt % aqueous solution of silver nitrate containing 5.4 wt % nitric acid was treated in the general manner set forth in Example 1. The silver nitrate solution being treated originally contained the following metal contaminants:

| METAL | PPM BASED ON SILVER NITRATE |
|---|---|
| Iron | 2,000 |
| Copper | 1,000 |
| Chromium | 600 |
| Nickel | 400 |
| Lead | 150 |

The purified silver recovered from the process contained the following metal contaminants:

| METAL | PPM BASED ON SILVER |
|---|---|
| Copper | 0.5 |

-continued

| METAL | PPM BASED ON SILVER |
|---|---|
| Iron | 3 |
| Lead | 1 |

In all of the above Examples recovery of silver was greater than 99% based on silver present in the silver nitrate being treated.

What is claimed is:

1. Method for recovery of metallic silver of high purity from acid insoluble silver salt contaminated with more than about 2,000 ppm other metals, which method comprises:

a. first washing said silver salt with water at a pH less than 3;

b. then reacting thus washed silver salt with alkali metal borohydride at a pH greater than 12 to form metallic silver; and c. recovering metallic silver contaminated with less than 1,000 ppm of such other metals.

2. Method according to claim 1 wherein the metal with which the acid insoluble silver salt is contaminated is selected from the group consisting of copper, nickel, iron, lead and mixtures thereof.

3. Method according to claim 1 wherein the acid insoluble silver salt is silver chloride.

4. Method for recovery of metallic silver of high purity from an aqueous solution of silver salt contaminated with more than about 2,000 ppm based on silver of other metals said method comprising:

a. precipitating silver from said solution as acid insoluble silver salt;

b. washing such acid insoluble silver salt with water at a pH of less than 3;

c. reacting thus washed silver salt with alkali metal borohydride at a pH greater than 12 to form metallic silver; and d. recovering metallic silver contaminated with less than 1,000 ppm of such other metals.

5. Method according to claim 4 in which the metal with which the silver is contaminated is selected from the group consisting of copper, nickel, iron, lead and mixtures thereof.

6. Method according to claim 4 wherein the aqueous solution of silver salt treated is in the form of silver nitrate and the acid insoluble silver salt is silver chloride.

7. Method according to claim 4 wherein the pH of the silver salt washed in step (b) is maintained less than 3 by addition of acid to the wash water.

8. Method according to claim 4 wherein following step (b) and prior to step (c) the pH of the silver salt is adjusted to greater than 12 by addition of alkali metal hydroxide to the aqueous slurry of silver salt resulting from step (b).

9. Method according to claim 4 wherein the pH of the silver salt during step (b) is maintained less than 3 by addition of nitric acid to at least a portion of the wash water and the pH of the resulting aqueous slurry of silver salt is adjusted to greater than 12 prior to step (c) by addition of sodium hydroxide.

* * * * *